United States Patent [19]

Sasser

[11] 3,942,509

[45] Mar. 9, 1976

[54] COMBINATION AIR INDUCED AND HEAT CIRCULATING LOG GRATE

[76] Inventor: Glen T. Sasser, 2964 Holly Drive, Tracy, Calif. 95376

[22] Filed: July 23, 1974

[21] Appl. No.: 490,923

[52] U.S. Cl. ..... 126/121; 126/127; 126/164; 237/51

[51] Int. Cl.[2] ..... F24B 7/00

[58] Field of Search ..... 126/120–124, 126/163 R, 135, 164, 165, 143; 237/51; 251/340; 137/625.31

[56] References Cited

UNITED STATES PATENTS

| | | | |
|---|---|---|---|
| 650,294 | 5/1900 | Bouland | 251/340 |
| 1,174,897 | 3/1916 | Preston | 137/625.31 |
| 2,258,882 | 10/1941 | Craig | 126/121 |
| 2,671,440 | 3/1954 | Dupler | 126/127 |
| 3,001,521 | 9/1961 | Reilly | 237/51 |
| 3,240,206 | 3/1966 | Schutt | 126/127 |
| 3,269,383 | 8/1966 | Maasberg | 126/164 |
| 3,499,432 | 3/1970 | Hannebaum | 126/120 |

FOREIGN PATENTS OR APPLICATIONS

| | | | |
|---|---|---|---|
| 1,023,682 | 3/1966 | United Kingdom | 237/51 |
| 179,812 | 5/1922 | United Kingdom | 126/165 |

*Primary Examiner*—John J. Camby
*Assistant Examiner*—Henry C. Yuen
*Attorney, Agent, or Firm*—Clarence A. O'Brien; Harvey B. Jacobson

[57] ABSTRACT

A combination air induced and heat circulating log grate having a heat transfer manifold mounted beneath the fuel retaining portion of an elevated grate. The manifold includes a header communicating with a plurality of apertured finger-like tubes through which air circulates. Perforated sleeves are arranged on the tubes for selectively blocking and unblocking the apertures of the tubes. The sleeves and apertured tubes form valves arranged for selectively inducing air into a fire associated with the grate.

5 Claims, 6 Drawing Figures

COMBINATION AIR INDUCED AND HEAT CIRCULATING LOG GRATE

BACKGROUND OF THE INVENTION

1. Field of the Invention

This invention relates generally to a fuel retaining grate for fireplaces, and the like, and particularly to a fuel retaining grate having air induction and heat circulating capabilities.

2. Description of the Prior Art

It is well known to arrange heat transfer manifolds in fireplaces, and the like. U.S. Pat. Nos. 3,001,521, issued Sept. 26, 1961 to A. L. Reilly, and 3,240,206, issued Mar. 15, 1966 to K. M. Schutt, disclose forced-draft heat transfer manifolds associated with fuel-retaining fireplace grates. Further, it is known to force air into a fire by means of the grate in order to increase efficiency of the burning of a particular fuel. See, for example, U.S. Pat. No. 3,269,383, issued Aug. 30, 1966 to W. A. Massberg.

U.S. Pat. Nos. also believed pertinent to the present invention are as follows:

| | |
|---|---|
| 606,667 | July 5, 1898 |
| 2,131,763 | Oct. 4, 1938 |
| 2,258,882 | Oct. 14, 1941 |
| 2,497,486 | Feb. 14, 1950 |
| 3,499,432 | Mar. 10, 1970 |

SUMMARY OF THE INVENTION

It is an object of the present invention to provide a fireplace grate for logs and other fuels that efficiently combines the air induction and heat circulating features described above.

It is another object of the present invention to provide an air induced grate having improved control over the amount of air injected into the fire on the grate.

These and other objects are achieved according to the present invention by providing a fireplace grate having: a fuel retaining grate; a manifold mounted on the grate; and valves associated with the manifold for selectively inducing air into a fire provided on the grate.

A preferred manifold according to the present invention advantageously includes a header and a plurality of substantially parallel, hollow fingers extending co-directionally from the header. At least one of the fingers is arranged for receiving air to be heated, while at least one other of the fingers is arranged for discharging air that has been heated by the fire on the grate.

Apertures are advantageously provided in the hollow fingers forming part of the manifold, and these apertures form part of the valves together with perforated sleeves arranged on the fingers in surrounding, or telescoping, manner. The perforations of each of the sleeves are selectively arrangeable in alignment with the associated apertures for permitting the passage of air from the finger, and in misalignment with the apertures for blocking passage of air from same. In this manner, selective opening and closing of the various sleeve formed valves permits adjustment of the amount and distribution of air injected into the fire.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
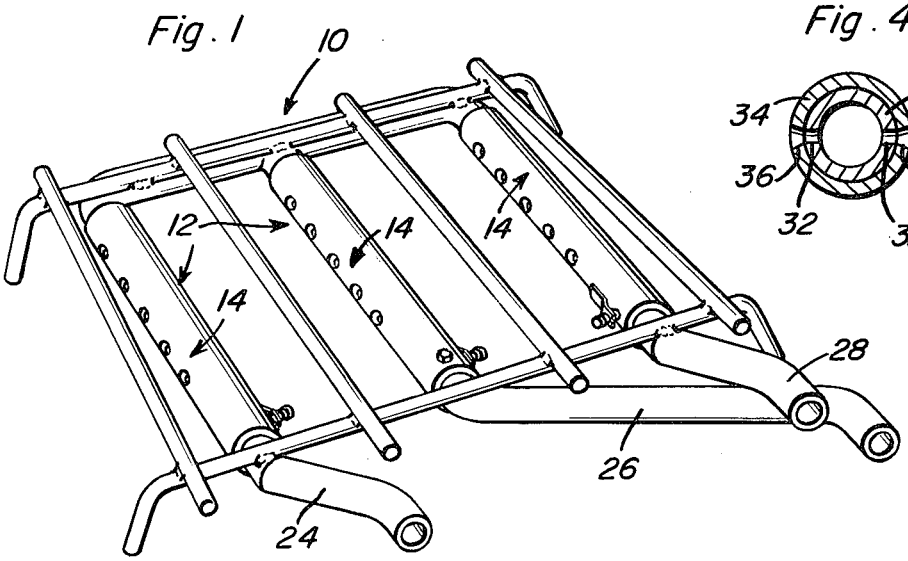
FIG. 1 is a perspective view showing a combination air induced and heat circulating fireplace grate according to the present invention.
Figure 2:
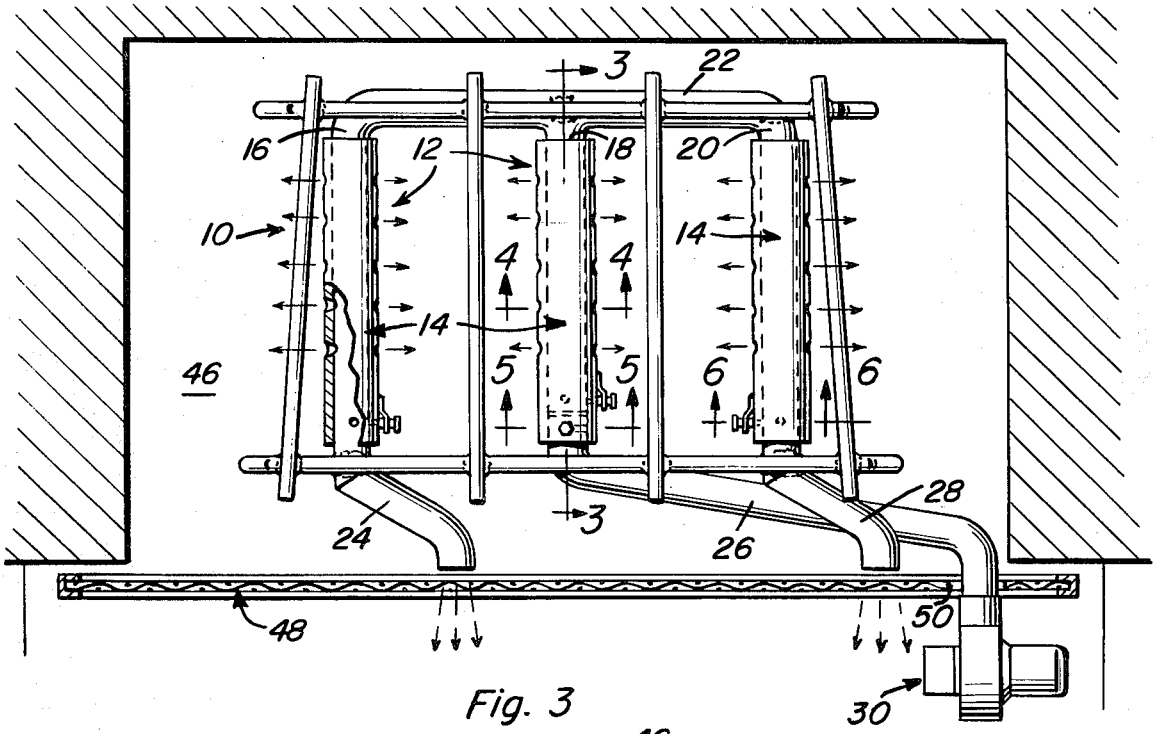
FIG. 2 is a fragmentary, top plan view, partly cutaway and in section, showing the grate of FIG. 1 arranged in a fireplace, with the fireplace shown in horizontal section.
Figure 3:
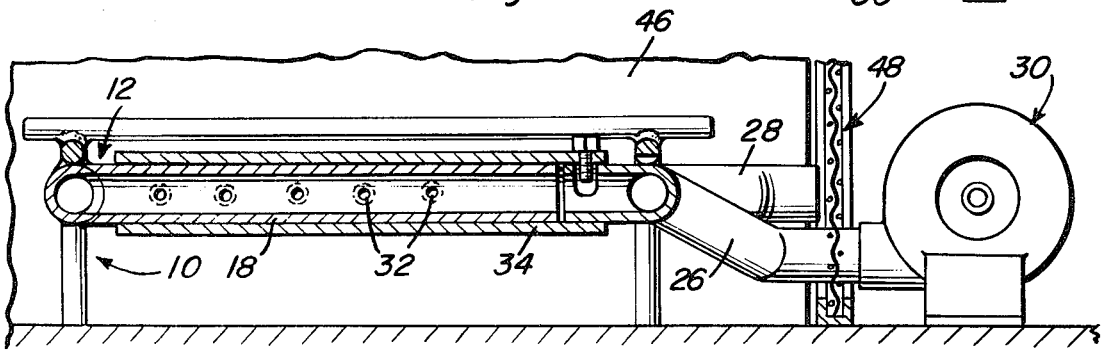
FIG. 3 is a fragmentary, sectional view taken generally along the line 3—3 of FIG. 2.

Referring now more particularly to FIGS. 1 through 3 of the drawings, a fuel retaining grate 10, generally constructed in the conventional manner of elevated tube or rod fabricated fireplace grates, has a manifold 12 mounted on the grate beneath the fuel retaining portion of the grate 10. Valves 14 associated with manifold 12 permit selective induction of air into a fire (not shown) on grate 10. It is to be understood that while one possible design and construction of a grate 10 is shown in the drawings, other suitable, known designs and constructions may be employed in carrying out the present invention. For example, the grate may be provided with an upstanding back portion for assisting in retaining logs (not shown) or like fuel, or both the front and back portions of the grate may be curved upwardly basket-fashion to assist in retaining the fuel.

Manifold 12 includes a plurality, three being shown in the drawings, of substantially parallel, hollow fingers 16, 18, and 20 extending co-directionally from a header 22. Finger 18 is illustrated as being arranged for receiving air to be heated, while fingers 16 and 20 are arranged for discharging heated air into a space (not shown) to be heated. This air flow is facilitated by discharge spouts 24 and 28, and an intake pipe 26. It will be appreciated that the orientation of spouts 24 and 28 may be varied to obtain desired flow patterns. Pipe 26 is advantageously connected to a conventional blower 30 for providing a forced draft to the associated finger 18.

Figure 4:
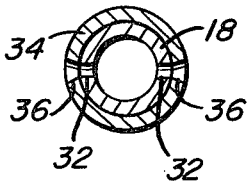
FIG. 4 is a sectional view taken generally along the line 4—4 of FIG. 2.

Valves 14 are partially formed by apertures 32 provided in fingers 16. 18, and 20. Sleeves 34 provided with perforations 36 (FIG. 4) are arranged in telescoping fashion on fingers 16, 18, and 20, one sleeve 34 to a finger. Perforations 36 of each of the sleeves 34 are selectively arrangeable in alignment with the associated apertures 32 for permitting the passage of air from the related fingers 16, 18, and 20. Perforations 36 are also arrangeable in misalignment with apertures 32 for blocking same. A simple clockwise or counterclockwise rotation of an individual sleeve 34 will result in the selected alignment or misalignment of perforations 36 of the selected sleeve 34 with the associated apertures 32.

Figure 5:
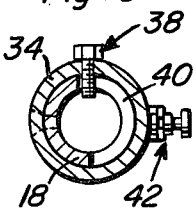
FIG. 5 is a sectional view taken generally along the line 5—5 of FIG. 2.
Figure 6:
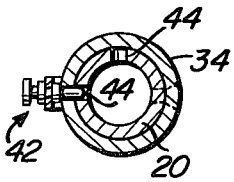
FIG. 6 is a sectional view taken generally along the line 6—6 of FIG. 2.

As can best be seen from FIGS. 5 and 6 of the drawings, a suitable retaining pin such as bolt 38 is received in an aperture in the sleeve 34 associated with finger 18 for connecting pipe 26 to the particular sleeve 34. Bolt 38 is received in a suitable slot 40 such that the union between pipe 26 and the middle sleeve 34 is in the form of a tolerance coupling which will permit the middle sleeve 34 to be rotated clockwise and counterclockwise to achieve the desired opening and closing of valve 14 associated with finger 18. Suitable lockpins 42 are provided with each of the sleeves 34 for selectively engaging in one of a plurality of radially arranged holes 44 provided in the associated fingers 16, 18, and 20 for retaining the sleeves 34 in a predetermined relationship with respect to their associated fingers. By arranging holes 44 at, for example, 90 degrees with respect to one another in the upper half of each finger 16, 18, and 20, the passage of air may be blocked when the associated sleeve 34 is in, for example, such a position that the associated lockpin 42 is arranged in the upwardly directed hole 44, while clockwise or counterclockwise rotation of the sleeves 34 will direct the flow of air either to the right or the left, respectively.

As can be seen from FIGS. 2 and 3 of the drawings, grate 10 may be arranged in a conventional fireplace 46 having associated therewith a conventional fireplace screen 48 provided with a suitable opening 50 for receiving pipe 26. When so arranged, blower 30 will feed air into finger 18 through pipe 26, and air will merely pass through header 22 and fingers 16 and 20 for passage out of spouts 24 and 28 and into a space, such as a room, to be heated. Appropriate adjustment of sleeves 34 will provide a desired air flow for assisting in complete combustion of the fuel being burned. While most fireplaces 46 efficiently burn only logs, and the like, a grate 10 according to the present invention allows fuel such as coal, and the like, to be employed with heat being brought into the space being heated instead of being lost up the chimney.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

What is claimed as new is as follows:

1. In combination with a fireplace having a generally horizontal bottom with a supporting grate means thereon for supporting combustible material above the bottom, upwardly extending side and rear walls, an open front by which the combustible material may be placed in position on the grate means for burning and an upwardly extending exhaust chimney means for combustion products, a heat exchange assembly mounted on the grate means comprising a cold air inlet tube positioned along the bottom of the fireplace and under the grate means adjacent the center portion thereof and extending from the open front to a point adjacent the rear wall and under said grate means, a pair of hot air tubes paralleling said cold air inlet tube adjacent the sides of the grate means and positioned along the bottom of the fireplace and under the grate means, a header interconnecting the inner ends of said tubes and positioned along the inner edge of and below the grate means, each of said tubes having a plurality of apertures therein for discharging combustion supporting air under the grate means, means circulating air through the tubes, said means including a fan communicated with the cold air inlet tube adjacent a lower corner portion of the open front of the fireplace, said grate means being removable from the fireplace with the tubes and header, said hot air tubes terminating in open discharge forward ends to discharge heated air from the lower portion of the open front of the fireplace, each of said air tubes includes a control means thereon for controlling the combustion supporting air discharged under the grate means, said fan providing a positive pressure in the tubes to prevent entry of combustion products, and said means controlling the discharge of combustion supporting air including a plurality of longitudinally spaced apertures in each of said tubes, a sleeve rotatably mounted on each of said tubes and including a plurality of apertures therein for alignment with and misalignment with the apertures in the tubes, lock means mounted on each of said sleeves and engageable with a respective tube for locking the sleeve in adjusted position, said apertures in the tubes and sleeves being oriented along a plane passing through the horizontal centers of the sleeves and tubes when the apertures are aligned for discharging combustion supporting air laterally of the tubes and sleeves and in underlying relation to the grate means substantially throughout the entire area thereof, said fan including a pipe extending to and connected with the air inlet tube at the front end of the fireplace, and means enabling angular relative movement between the inlet tube and pipe extending from the fan to enable variation in the position of the fan in relation to the inlet tube when installing the tubes and header in a fireplace, said tubes and header being rigidly fixed to the grate means with the discharge ends of the outlet tubes being disposed inwardly of a fireplace screen covering the open front of the fireplace, the pair of air outlet tubes forming a volume greater than the inlet tube to provide for expansion of the air as it is being heated when passing through the tubes.

2. A heater for installation in a fireplace comprising a centrally disposed front to rear cold air inlet tube, a pair of front to rear hot air outlet tubes, a header interconnecting the ends of the tubes adjacent the rear of the fireplace, a fan communicated with the front end of the air inlet tube, hot air discharge means at the front ends of the air outlet tubes, said tubes and header being generally horizontally disposed and oriented adjacent the bottom of the fireplace, and means providing controlled discharge of combustion supporting air into the interior of the fireplace adjacent the bottom and from front to rear thereof, and said combustion supporting air discharge means includes a plurality of spaced apertures in each of said tubes with the apertures being spaced along a major portion of the length of each tube, and a sleeve movably mounted on each of said tubes for selectively closing said apertures.

3. The structure as defined in claim 2 wherein each of said sleeves is provided with a plurality of apertures therein for alignment and misalignment with respect to the apertures in the tubes, and means releasably locking the sleeves in adjusted position on the tubes.

4. The structure as defined in claim 3 wherein said means releasably locking the sleeve in adjusted position on the tubes includes a radially disposed locking pin mounted on the front end portion of each sleeve, each of said tubes including circumferentially spaced openings releasably receiving the inner end of the locking pin to enable rotatable adjustment of the sleeves in a clockwise and counterclockwise direction, said apertures in the tubes and apertures in the sleeves being in longitudinal alignment and disposed along a substantially horizontal plane when the apertures in the tubes and sleeves are aligned for discharging air in both horizontal directions in underlying relation to a grate positioned in the fireplace.

5. The structure as defined in claim 4 wherein said fan is connected to the air inlet tube by a pipe, said pipe having an arcuate slot therein, the front end of said inlet tube including a bolt extending radially into the slot in the pipe to enable angular movement of the pipe in relation to the inlet tube to position the fan in a desired location within the limits defined by the bolt and slot connection between the pipe and inlet tube.

* * * * *